US006409404B1

(12) United States Patent
Piech

(10) Patent No.: US 6,409,404 B1
(45) Date of Patent: Jun. 25, 2002

(54) MINIATURE PEN WITH HOLDER THAT HAS AN ADHESIVE MOUNTING STRIP

(76) Inventor: Michael Matthew Piech, 85 Densmore, Buffalo, NY (US) 14220

( * ) Notice: Subject to any disclaimer, the term of this patent is extended or adjusted under 35 U.S.C. 154(b) by 0 days.

(21) Appl. No.: 10/054,367

(22) Filed: Oct. 29, 2001

Related U.S. Application Data

(60) Provisional application No. 60/249,050, filed on Nov. 15, 2000.

(51) Int. Cl.[7] ..... B43K 23/02

(52) U.S. Cl. ..... 401/131; 24/10 R; 24/11 CT; 206/371

(58) Field of Search ..... 401/131, 195, 401/57; 24/10 R, 11 CT; 206/371, 460, 214; D3/206

(56) References Cited

U.S. PATENT DOCUMENTS 1,669,342 A * 5/1928 Mayol ..... 401/57
2,365,802 A * 12/1944 Browse ..... 24/11 CT
3,629,867 A * 12/1971 Taylor ..... 2/160
5,259,095 A * 11/1993 Tam ..... 24/10 R
5,640,743 A * 6/1997 Greene et al. ..... 24/10 R
5,791,798 A * 8/1998 Yu ..... 401/57

* cited by examiner

*Primary Examiner*—David J. Walczak

(57) ABSTRACT

A miniature pen that is handy to carry and mounts to personal accessories such as wallets, cellular telephones, etc. for casual note taking. It is composed of a rigid, thin, tubular writing cartridge (14) approximately 2.5 inches in length and a sheathlike holder (18) that has an adhesive mounting strip (12). The writing cartridge (14) slides out of the sheathlike holder (18) for usage. For storage the writing cartridge (14) slides into the sheathlike holder and rests snugly inside the sheath (18) via the friction dimple (8). One side of the sheathlike holder (18) possesses a strip of adhesive mounting tape (12). When mounting is desired, the thin protective cover is removed from the tape, thus exposing the adhesive, and the sheath is placed on the personal accessory.

6 Claims, 2 Drawing Sheets

MINIATURE PEN WITH HOLDER THAT HAS AN ADHESIVE MOUNTING STRIP

CROSS-REFERENCE TO RELATED APPLICATIONS

This application is entitled to the benefit of Provisional Patent Application Ser. No. 60/249,050, filed Nov. 15, 2000.

BACKGROUND

1. Field of Invention

This invention relates to a ball-point pen which is small in size and which adheres to a multitude of objects and surfaces.

2. Description of Prior Art

The need for a pen which is convenient to carry on the person and is unlikely to be forgotten so as to be available for casual use is well recognized.

The majority of ball-point pens for everyday use have traditionally included a rigid, round or prismatic body and are commonly approximately six inches in length so as to require retention in the relatively protected environment such as the breast pocket of a shirt or the front/back pocket of trousers. This practice is uncomfortable to the carrier and is susceptible to bending or breaking thereby permanently damaging both the pen and the garment due to leakage of ink.

In addition, when changing their clothing people often forget pens when transferring other essential accessories such as pocketbooks, cellular phones, etc., especially when continuous use of a pen is not required.

A professional Patent search was conducted and revealed inventions that have attempted to solve this common problem. This prior art is as follow:

U.S. Pat. No. 4,568,213 issued to Money in 1986 teaches of a foldable pen with cap that when flat, can be used as a bookmark. When the pen is to be used for writing, it folds into a triangular prism to be grasped by the hand. The conventional size of this pen does not allow for continuous personal carriage of which is comfortable, convenient and conducive to garment protection. Also, the very nature of the triangular design of the pen does not allow for comfortable writing.

U.S. Pat. No. 4,732,504, issued to Telli in 1988 teaches of a flexible flat ball-point pen. In general, flexible pens are not adequate writing utensils due to their lack of rigidity, thereby making them difficult to control. Also, the flexible property causes the pen to fold back onto itself. The flexibility of the pen does not lessen the tendency for an individual to forget the pen when transferring other personal accessories from one pair of trousers to another pair of trousers. In addition, the design and conventional size prevents carriage within a pocketbook or affixed to a cellular phone.

U.S. Pat. No. Des. 302,985 issued to Vinck in 1989, teaches of a card-type pen with cap consisting of a ball-point pen that fits snugly into a credit card receiving pocket of a pocket book, The perimetrical dimensions of this pen mimic that of a typical credit card. The thin rectangular design of this pen makes it quite awkward to write with. Also, the plurality of steps involved in retrieval and usage of this pen make it frustrating and inconvenient to use.

U.S. Pat. No. 5,897,261 issued to Goetz in 1999, teaches a ball-point pen with cap with an overall length which is approximately equal to a conventional credit card enabling the pen to fit snugly in a credit card receiving pocket of a pocket book. This pen has a thin flat body containing a writing cartridge. The corners of the body at the writing/front end are angular and the rear corners are rounded. Also, the shape of the body is tapered so that the rear end of the pen is wider than the writing/front end.

U.S. Pat. No. 4,815,880 issued to Sekiguchi in 1989 teaches of a card type writing instrument. This writing instrument has a plastic casing with recesses that are filled by the writing elements. The dimensions of the casing mimic those of a conventional credit card, thus the writing elements are even smaller than the case, making them very difficult for writing. The retrieval of the case from the pocketbook coupled with the complicated procurement of the writing elements is a time consuming operation, especially in less than favorable lighting situations, social occasions, etc. Also, the hole for which the pen tip is inserted to secure the pen to the plastic casing is open, thus exposing the pocketbook or garment to ink if the pen were to leak.

U.S. Pat. No. 5,897,261 and U.S. Pat. No. Des. 302,985 and U.S. Pat. No. 4,815,880 are all limited to receiving pockets of pocket books. Also, they require excessive space in an individual's wallet when only the cartridge portion of the pen is needed for such brief, casual use i.e. phone numbers, internet addresses etc. The design of these pens does not allow for storage on other essential personal accessories such as cellular phones, pocket calculators, cigarette lighters, checkbooks, Palm Pilots, Laptop computers, etc. In addition, the design of these card-style pens requires the use of two hands and numerous operating steps They do not offer easy access and simple operation. Finally, the design of these pens does not have an affixed receiving base which makes them susceptible to non-returned borrowing and general misplacement due to forgetfulness.

Accordingly, there remains a need for a ball-point pen which is adapted for direct storage on a multitude of personal accessories, which is quite handy to carry continuously on one's person and which is in a compact form available for quick, direct use. Also, the simple construction of the pen allows for manufacture using conventional mass production techniques for high volume production at low cost. My invention possesses all of these characteristics. However, all the pens designed for handy carriage heretofore known suffer from a number of disadvantages:

(a) Their design or size is limited to either pockets or pocketbooks that contain a receiving pocket for conventional size credit cards.

(b) Their operation is time consuming and complicated. It involves several steps: retrieval of the entire unit, two handed removal/replacement of the cap and then replacement of the capped unit back into the receiving pocket of the pocketbook.

(c) Their design is unnecessarily bulky and requires valuable storage space in pockets or pocketbooks.

(d) The whole unit is independent and not affixed. This design increases the likelihood of the pen being misplaced, forgotten or the subject of non-returned borrowing from another individual in need of such a device.

(e) Their design and placement is conducive to breakage and leakage causing damage to personal accessories and damage to the carriers garments.

SUMMARY

In accordance with the present invention a miniature pen comprises an elongated writing cartridge that fits snugly into a sheathlike holding element having an adhesive mounting strip.

OBJECTS AND ADVANTAGES

Accordingly, several objects and advantages of the present invention are:

(a) Extreme versatility: for use on several items such as wallets, cellular telephones, checkbooks, television remote controls, cigarette lighters, laptop computers, handheld computers, personal radios, calculators, text books, car dashboards, sunglasses, golfing equipment, backpacking equipment, makeup cases, key chains, etc.;

(b) quick, convenient, one hand operation;

(c) compact size;

(d) stationary base reduces loss;

(e) garment friendly design.

DRAWING FIGURES

The ball-point pen according to my invention will now be described with reference to the accompanying drawings in which.

REFERENCE NUMERALS IN DRAWINGS

Figure 1:
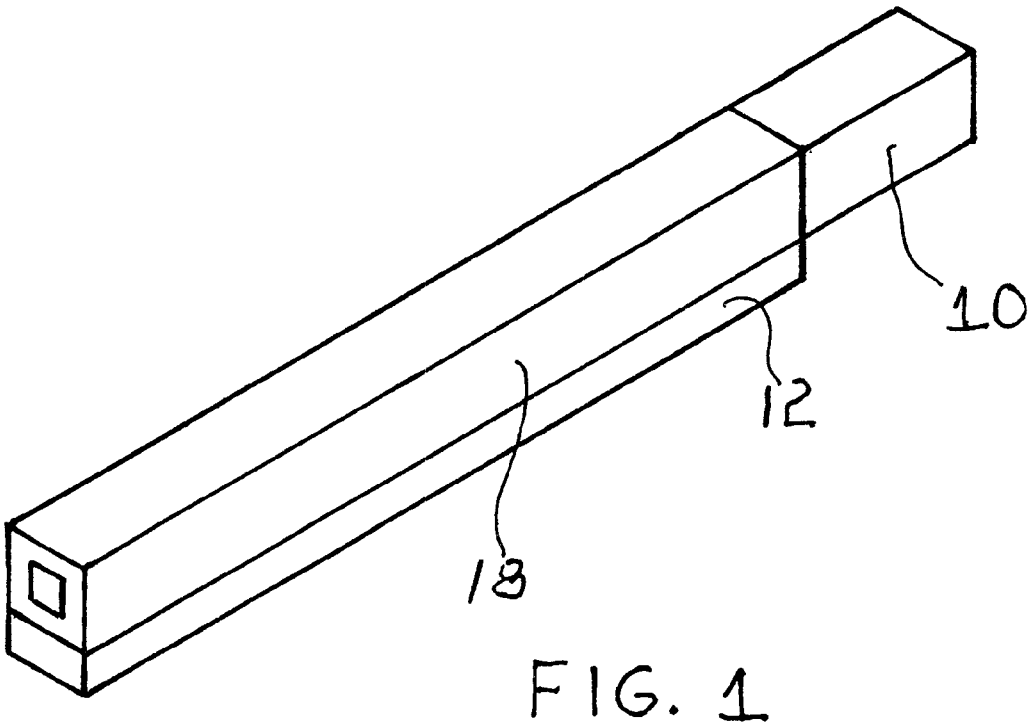
FIG. 1 is an isometric assembled view of the ball-point pen.

7 epoxy adhesive
8 friction dimple
10 writing cartridge end cap
12 adhesive mounting strip
14 writing cartridge
16 epoxy filler
18 sheath

DESCRIPTION

Figure 3:
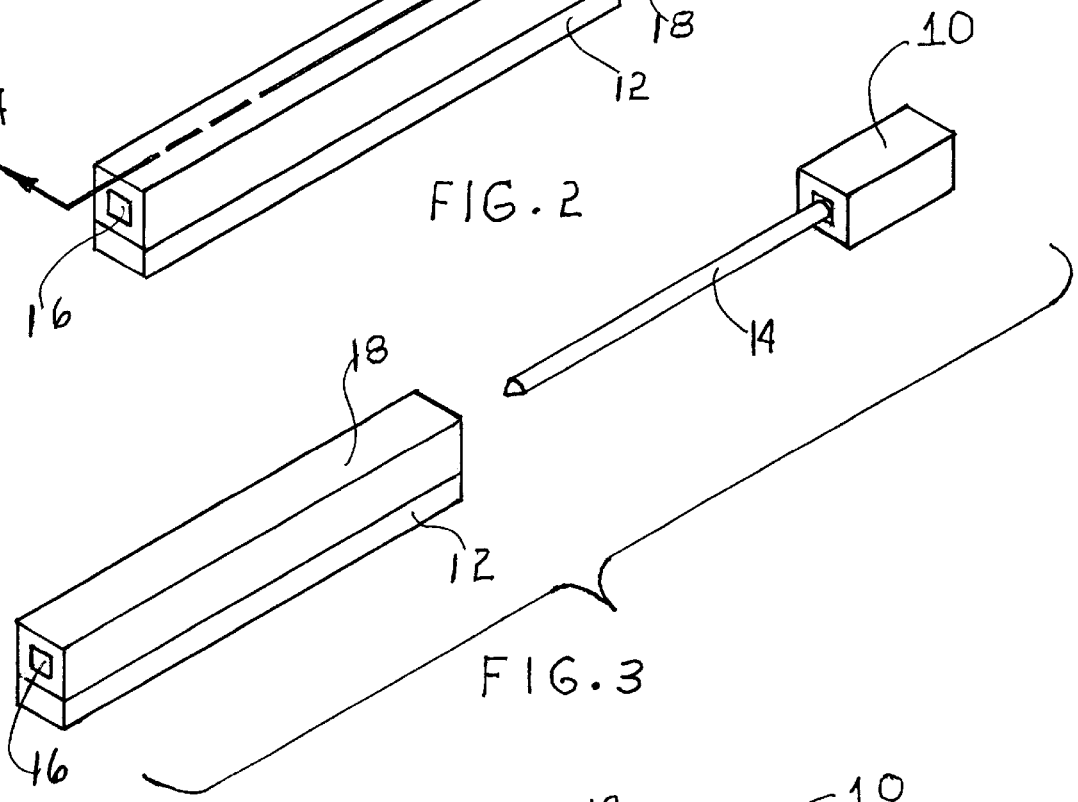
FIG. 3 is an isometric view with sheath exploded from writing cartridge.
Figure 4:
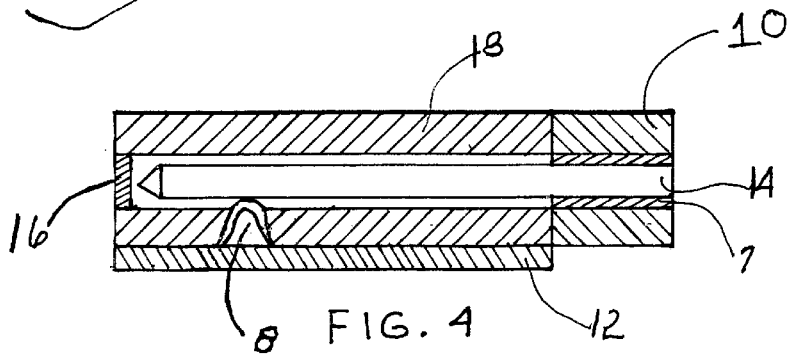
FIG. 4 is a cross-sectional view of the ball-point pen.

As shown in FIG. 3, The ball-point pen is composed of three main parts: the writing cartridge 14, the sheath 18 and the adhesive mounting strip 12. The writing cartridge 14 is of conventional design having a rigid tubular ink reservoir of metal and which is connected to a ball-point tip. The sheath 18 is constructed of an elongate piece of square brass tubing approximately 3 mm by 3 mm. and with a length of approximately 54 mm. The writing cartridge end cap 10 is also composed of the same square brass tubing and has a length of approximately 7 mm. As shown in FIG. 4, the writing cartridge end cap 10 is permanently secured to the writing cartridge by means of an epoxy glue material which is designated as the epoxy adhesive 7. The same epoxy glue material is also used to cover the end of the hollow sheath 18, in this regard the epoxy glue material is designated as the epoxy filler 16. The remaining component of the pen is the adhesive mounting strip 12. The presence and function of this adhesive mounting strip 12 is what makes the design of this pen surpass any other previously designed handy to carry pen. The adhesive mounting strip 12 is composed of common double-faced tape. One side of the tape is affixed to the sheath and trimmed accordingly with an Exacto knife. The other side of the tape is left covered until mounting of the unit is desired.

OPERATION

Figure 2:
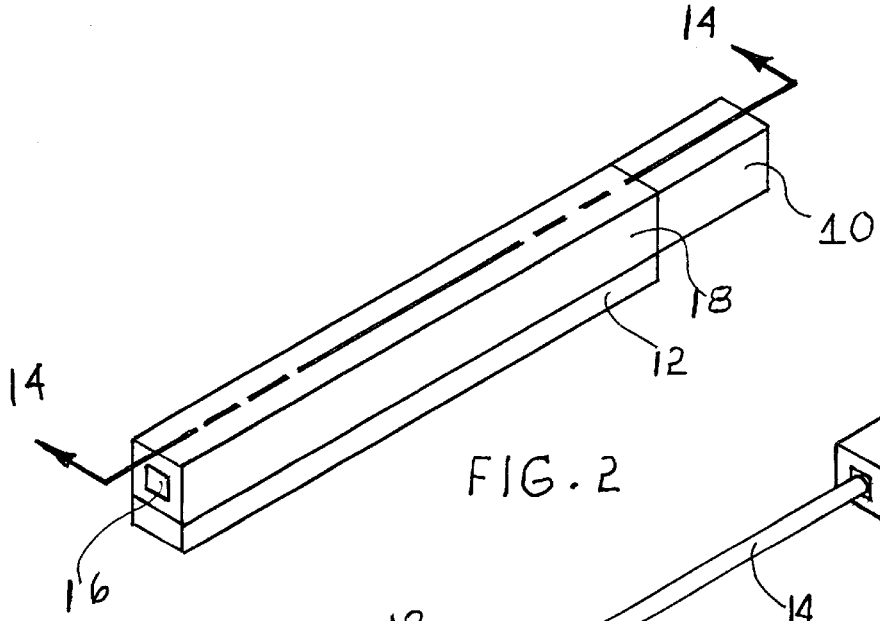
FIG. 2 is an isometric view illustrating the sectional plane.

The operation of this ball-point pen is a simple twofold process. (1) Mounting the sheath 18 of the pen and (2) Retrieval/Replacement of the pen. The first process of mounting the sheath 18 of the pen is done simply by peeling off the remaining plastic cover from the double faced tape, hence exposing the sticky surface, and placing it on the surface of the chosen accessory such as a wallet or cellular phone. The second process of retrieval/replacement of the pen is also quite simple. This process requires the use of only one hand to grasp the writing cartridge end cap 10 and pull it from the sheath for retrieval and push it into the sheath for replacement. FIG. 2 and FIG. 3 clearly show that the writing cartridge 14 slides into the sheath 18. FIG. 4 shows that the writing cartridge 14 rests snugly within the sheath due to the creation of the friction dimple 8. The friction dimple 8 is a small obtrusion on the inside of the sheath 18. The friction dimple 8 is created simply by crimping the brass tube with a crimping tool. As shown in FIG. 4, the friction dimple 8 is specifically located at the end of the sheath 18 opposite the receiving end and on the inner side of the square brass tubing opposite the mounting adhesive strip 12. This placement allows the indentation created by fiction dimple 8 to be hidden by the double-faced tape. The shaft of the writing cartridge 14 makes contact with the friction dimple and creates a slight resistance. It is this interaction which secures the writing cartridge 14 during storage.

CONCLUSION, RAMIFICATIONS, AND SCOPE

Accordingly, the reader will see that the ball-point pen of this invention can be used for easy and convenient casual note taking, can be affixed to a wide variety of objects, is quite compact and will reduce misplacement/loss of the pen.

Although the description above contains many specificities, these should not be construed as limiting the scope of the invention but merely providing an illustration of the preferred embodiment of this invention. Many other variations are possible. For example, the holding unit could be made of plastic, wood, graphite, steel, textile, cloth etc. The holding unit could be of any shape either triangular, round etc. or of any size such as thicker/thinner or longer/shorter etc. In addition, the adhesive mounting strip could be substituted with a special glue, stickum type putty, hooks, latches, hook and loop fastener etc. Finally, the writing cartridge is not limited to just a ball-point mechanism. Rather, the ball-point cartridge could be replaced with pencil lead, felt-tip, fountain style, or simply left with no writing material. This last option would allow the instrument to be used as an stylus for use with Palm Pilots or other "screen input" computer devices.

Thus the scope of the invention should be determined by the appended claims and their legal equivalents, rather than by the examples given.

I claim:

1. A writing instrument comprising:

a one-piece elongated tubular sheath formed from a tube having a constant cross-section and having first and second ends;

a writing cartridge having a writing end and an opposite end;

an end cap having a constant coss-section and having substantially the same cross-section as said elongated tubular sheath wherein said end cap is secured to said opposite end of said writing cartridge and has a length substantially less than a length of said elongated tubular sheath; and a mounting strip secured along a length of said elongated tubular sheath and adapted to secure the writing instrument to a chosen surface wherein said writing cartridge is insertable into said first end of said elongated tubular sheath such that an end of said end cap abuts said first end of said elongated tubular sheath to thereby store said writing cartridge within said elongated tubular sheath.

2. The writing instrument defined in claim 1 wherein said mounting strip is one of an adhesive strip or a hook and loop fastener.

3. The writing instrument defined in claim 1 wherein said elongated tubular sheath and said end cap are made from one of brass, plastic, wood, graphite or steel.

4. The writing instrument defined in claim 1 wherein the cross-section of said elongated tubular sheath and said end cap is one of square, triangular or round.

5. The writing instrument defined in claim 1 wherein a friction dimple is disposed within said elongated tubular sheath for frictionally engaging said writing cartridge to thereby secure said writing cartridge within said elongated tubular sheath.

6. The writing instrument defined in claim 1 wherein said second end of said elongated tubular sheath is filled with a filler.

* * * * *